US009368335B1

(12) United States Patent
Quarmby et al.

(10) Patent No.: US 9,368,335 B1
(45) Date of Patent: Jun. 14, 2016

(54) MASS SPECTROMETER

(71) Applicant: Thermo Finnigan LLC, San Jose, CA (US)

(72) Inventors: Scott T. Quarmby, Round Rock, TX (US); Berg A. Tehlirian, Daly City, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/611,682

(22) Filed: Feb. 2, 2015

(51) Int. Cl.
*H01J 49/24* (2006.01)
*H01J 49/04* (2006.01)
*F04D 19/04* (2006.01)

(52) U.S. Cl.
CPC ..... *H01J 49/24* (2013.01); *F04D 19/046* (2013.01); *H01J 49/0422* (2013.01); *H01J 49/0481* (2013.01); *F04D 19/042* (2013.01)

(58) Field of Classification Search
CPC ..... F04D 19/042; F04D 19/046; H01J 49/24; H01J 49/0422; H01J 49/0481
See application file for complete search history.

(56) References Cited

U.S. PATENT DOCUMENTS 5,298,743 A 3/1994 Kato
5,818,041 A * 10/1998 Mordehai ..... H01J 49/063 250/281
6,797,948 B1 9/2004 Wang
7,866,940 B2 * 1/2011 Stones ..... F04D 17/168 415/143
8,106,354 B2 * 1/2012 Henry ..... F04D 19/042 250/289
8,716,658 B2 * 5/2014 Stones ..... F04D 19/042 250/289
2003/0141449 A1 7/2003 Wells et al.
2007/0181802 A1 * 8/2007 Yamada ..... H01J 49/107 250/288
2008/0138219 A1 * 6/2008 Stones ..... F04D 17/168 417/423.4
2008/0193303 A1 * 8/2008 Stones ..... F04D 19/042 417/251
2010/0176294 A1 * 7/2010 Henry ..... F04D 19/042 250/289
2010/0187415 A1 * 7/2010 Schneiders ..... F04D 29/70 250/289
2011/0036980 A1 * 2/2011 Lisa ..... H01J 49/004 250/288
2011/0253888 A1 10/2011 Badiei et al.
2012/0132800 A1 * 5/2012 Stones ..... H01J 49/24 250/288
2012/0138790 A1 * 6/2012 Wright ..... H01J 49/0013 250/288
2012/0261570 A1 * 10/2012 Shvartsburg ..... H01J 49/066 250/287
2013/0175442 A1 * 7/2013 Yamada ..... H01J 49/0495 250/288
2013/0177453 A1 * 7/2013 Stones ..... F04D 19/042 417/250
2013/0259711 A1 * 10/2013 Burggraf ..... F04B 23/08 417/53
2014/0306103 A1 * 10/2014 Gordon ..... H01J 49/067 250/282
2014/0369807 A1 * 12/2014 Stones ..... F04D 17/168 415/11

FOREIGN PATENT DOCUMENTS

EP 2375080 A2 10/2011
WO WO 2011/031559 A1 3/2011
WO WO 2014/191750 A1 12/2014

* cited by examiner

*Primary Examiner* — Wyatt Stoffa
(74) *Attorney, Agent, or Firm* — David A. Schell

(57) ABSTRACT

A mass spectrometer system can include a vacuum manifold and a high vacuum pump. The vacuum manifold can include a foreline chamber and a high vacuum chamber. The foreline chamber can have a source inlet, a foreline inlet, and a foreline outlet. The high vacuum pump can have a vacuum port coupled to high vacuum chamber, and a foreline port coupled to the foreline inlet.

26 Claims, 4 Drawing Sheets

MASS SPECTROMETER

FIELD

The present disclosure generally relates to the field of mass spectrometry including vacuum manifolds and vacuum systems.

INTRODUCTION

Mass spectrometry generally relies upon the relatively collision free movement of ions. Ions colliding with neutral gas molecules can cause fragmentation of the ions, reducing the number of full mass ions to be analyzed and detected. Additionally, collisions between ions and neutral gas molecules can alter the trajectory and velocity of the ions. If the trajectory is sufficiently altered, the ion may be deflected out of an ion path and be lost, further reducing the number of ions to be analyzed and detected. Further, mass analyzers can rely upon velocity of ions. Altering the velocity of the ion through collisions with neutral gas molecules can adversely affect the analysis of the mass of the ion.

Mass spectrometer systems typically operate under high vacuum to maximize the mean free path of the ions. However, the source may be at atmospheric pressure and the ions may enter the system with a substantial flow of gas molecules. To maintain the high vacuum for the mass analyzer while allowing the ions to travel into the mass analyzer requires separating the ions from the gas molecules and removing the gas molecules from the mass spectrometer system.

From the foregoing it will be appreciated that a need exists for improved vacuum systems for mass spectrometry.

SUMMARY

In a first aspect, a mass spectrometer system can include a vacuum manifold having a foreline chamber with a foreline inlet and a foreline outlet, and a high vacuum chamber. The mass spectrometer system can further include a high vacuum pump having a vacuum port coupled to high vacuum chamber; and a foreline port coupled to the foreline inlet.

In various embodiments of the first aspect, the mass spectrometer system can further include a foreline pump coupled to the foreline outlet.

In various embodiments of the first aspect, the foreline chamber can be operable at a pressure of between about 0.1 Torr and about 10 Torr.

In various embodiments of the first aspect, the high vacuum chamber can be operable at a pressure of between about $1\times10^{-12}$ Torr and about $1\times10^{-3}$ Torr.

In various embodiments of the first aspect, the mass spectrometer system can further include an intermediate vacuum chamber between the foreline chamber and the high vacuum chamber. In particular embodiments, the intermediate vacuum chamber can be operable at a pressure of between about $1\times10^{-4}$ Torr and $2\times10^{-1}$ Torr.

In various embodiments of the first aspect, the mass spectrometer system can further include two intermediate vacuum chambers between the foreline chamber and the high vacuum chamber.

In various embodiments of the first aspect, the mass spectrometer system can further include a mass analyzer within the high vacuum chamber.

In various embodiments of the first aspect, the vacuum manifold can be a monolithic vacuum manifold or a multicomponent vacuum manifold.

In a second aspect, a mass spectrometer system can include a vacuum manifold and a high vacuum pump. The vacuum manifold can include a foreline chamber having a foreline inlet and a foreline outlet, a high vacuum chamber, and an intermediate vacuum chamber located between the foreline chamber and the high vacuum chamber. The high vacuum pump can include a main stage coupled to the high vacuum chamber, an intermediate stage coupled to the intermediate vacuum chamber, and foreline port coupled to the foreline chamber. The gases from the high vacuum pump can flow through the foreline chamber and out to a foreline pump via the foreline outlet.

In various embodiments of the second aspect, the foreline chamber can be operable at a pressure of between about 0.1 Torr and about 10 Torr.

In various embodiments of the second aspect, the high vacuum chamber can be operable at a pressure of between about $1\times10^{-12}$ Torr and about $1\times10^{-3}$ Torr.

In various embodiments of the second aspect, the intermediate vacuum chamber can be operable at a pressure of between about $1\times10^{-4}$ Torr and $2\times10^{-1}$ Torr.

In various embodiments of the second aspect, the mass spectrometer can further include a mass analyzer within the high vacuum chamber.

In various embodiments of the second aspect, the mass spectrometer can further include a second intermediate vacuum chamber located between the intermediate vacuum chamber and the high vacuum chamber.

In various embodiments of the second aspect, the vacuum manifold can be a monolithic vacuum manifold or a multicomponent vacuum manifold.

In a third aspect, a vacuum manifold for a mass spectrometer system can include a foreline chamber, a first intermediate vacuum chamber, a second intermediate vacuum chamber, and a high vacuum chamber. The foreline chamber can have a source inlet, a foreline inlet, and a foreline outlet. The first intermediate vacuum chamber can be separated from the foreline chamber by a first baffle with a first baffle aperture, the second intermediate vacuum chamber can be separated from the first intermediate vacuum chamber by a second baffle with a second baffle aperture, and the high vacuum chamber can be separated from the second intermediate vacuum chamber by a third baffle with a third baffle aperture. The first intermediate vacuum chamber can have a first vacuum outlet, the second intermediate vacuum chamber can have a second vacuum outlet, and the high vacuum chamber can have a third vacuum outlet.

In various embodiments of the third aspect, the foreline outlet can be adapted for connection to a foreline pump.

In various embodiments of the third aspect, the foreline inlet, the first vacuum outlet, the second vacuum outlet, and the third vacuum outlet can be adapted for connection to a multiport high vacuum pump.

In various embodiments of the third aspect, the first baffle aperture can have a cross-sectional area of between about 0.4 $mm^2$ and about 40 $mm^2$.

In various embodiments of the third aspect, the second baffle aperture can have a cross-sectional area of between about 0.4 $mm^2$ and about 40 $mm^2$.

In various embodiments of the third aspect, the third baffle aperture can have as a cross-sectional area of between about 0.4 $mm^2$ and about 40 $mm^2$.

In various embodiments of the third aspect, the first vacuum outlet can have a cross-sectional area of between about 400 $mm^2$ and about 12,000 $mm^2$.

In various embodiments of the third aspect, the second vacuum outlet can have a cross-sectional area of between about 400 $mm^2$ and about 12,000 $mm^2$.

In various embodiments of the third aspect, the third vacuum outlet can have a cross-sectional area of between about 5,000 $mm^2$ and about 36,000 $mm^2$.

In various embodiments of the third aspect, the vacuum manifold can be a monolithic vacuum manifold or a multi-component vacuum manifold.

DRAWINGS

For a more complete understanding of the principles disclosed herein, and the advantages thereof, reference is now made to the following descriptions taken in conjunction with the accompanying drawings, in which.

Figure 1:
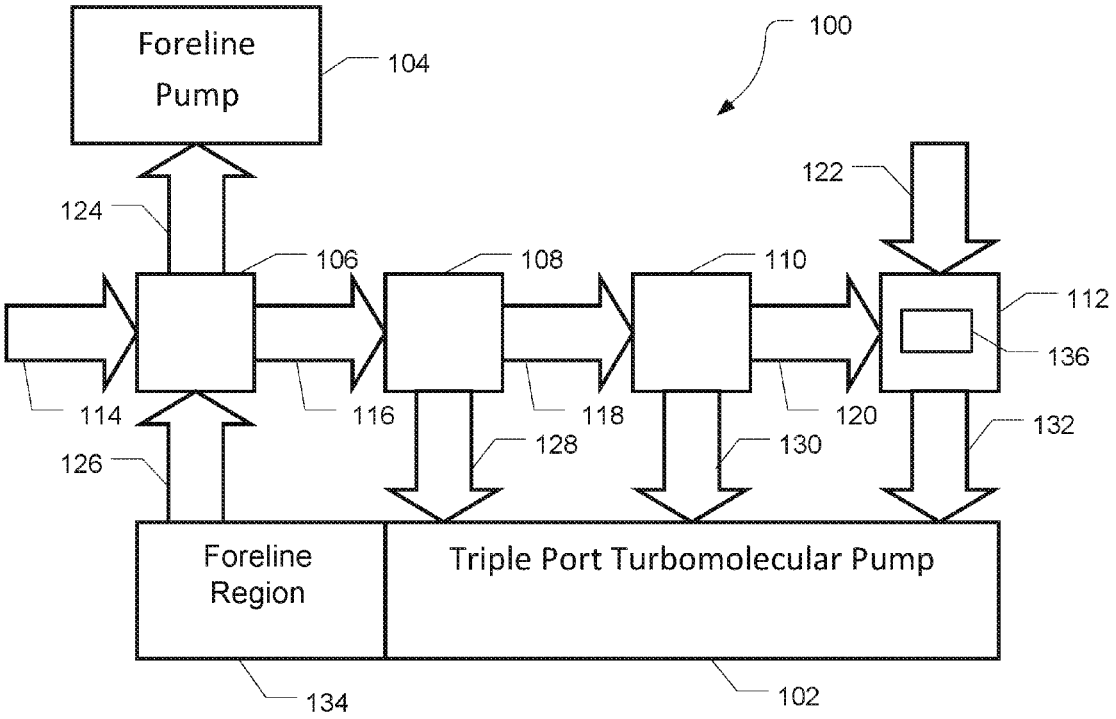
FIG. 1 is a block diagram illustrating an exemplary vacuum system for a mass spectrometer, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of vacuum manifolds and vacuum systems are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

FIG. 1 is a block diagram illustrating an exemplary vacuum system 100 for a mass spectrometer. Vacuum system 100 can include a multiport high vacuum pump 102 and a foreline pump 104. High vacuum pump 102 can include a main stage that receives gas molecules in a molecular or transitional flow. Additionally, the high vacuum pump 102 can include additional stages that receive gas molecules in a molecular, transitional, or viscous flow. While the high vacuum pump 102 can compress the gases to a viscous flow, the high vacuum pump 102 may be unable to compress the gases sufficiently to exhaust to atmosphere. In various embodiments, the high vacuum pump 102 can include a turbomolecular stage, a Gaede stage, a Holweck stage, a Siegbahn stage, a molecular drag stage, a regenerative stage, or any combination thereof.

The foreline pump 104 can take gases in a viscous flow, such as those from the high vacuum pump 102, and further compress the gases for exhausting to atmosphere. In various embodiments, the foreline pump may include a rotary vane pump, a scroll pump, a roots blower, a diaphragm pump, or the like.

Vacuum system 100 can further include multiple vacuum chambers, including a foreline chamber 106, intermediate vacuum chamber 108, intermediate vacuum chamber 110, and high vacuum chamber 112.

In various embodiments, a mass analyzer and detector can be housed in high vacuum chamber 112. Foreline chamber 106 can house elements such as ion guides and skimmers to separate the ions from neutral gas molecules. Intermediate vacuum chambers 108 and 110 can include various ion optics to guide the ions from the foreline chamber 106 to the mass analyzer 136 in the high vacuum chamber 112. Additionally, intermediate vacuum chambers 108 and 110 can act to step down the pressure to maintain a high vacuum in high vacuum chamber 112. In various alternate embodiments, there may be more or fewer intermediate vacuum chambers between foreline chamber 106 and high vacuum chamber 112.

In various embodiments, ions and gas molecules can enter the mass spectrometer system via inlet 114. The ions can be separated from the bulk of the gas molecules in the foreline chamber 106. The separated gas molecules can be exhausted to the foreline pump 104 via outlet 124. Ions can travel into intermediate vacuum chamber 108 via aperture 116 between foreline chamber 106 and intermediate vacuum chamber 108. Ions can then travel into intermediate vacuum chamber 110 via aperture 118 between intermediate vacuum chamber 108 and intermediate vacuum chamber 110. The intermediate vacuum chambers 106 and 108 can act to separate the ions from gas molecules remaining after the foreline chamber. Ions can then travel into the high vacuum chamber 112 via aperture 120 between high vacuum chamber 112 and intermediate vacuum chamber 110. Cooling or collision gases can be supplied into high vacuum chamber 112 via inlet 122 and directed to appropriate portions of the mass analyzer, as needed. For example, a collision gas can be supplied to a collision chamber for MS-MS experiments where ions of a particular mass/charge ratio are fragmented and the mass of the fragments determined to elucidate the structure of the ions.

In various embodiments, intermediate vacuum chamber 108, intermediate vacuum chamber 110, and high vacuum chamber 112 can be maintained under vacuum using high vacuum pump 102. Gas molecules can travel out of intermediate vacuum chamber 108 to high vacuum pump 102 through outlet 128. Gas molecules can travel out of intermediate vacuum chamber 110 to high vacuum pump 102 through outlet 130. Gas molecules can travel out of high vacuum chamber 112 to high vacuum pump 102 through outlet 132. High vacuum pump 102 can force the gas molecules it has collected to foreline region 134. The gas molecular can be drawn from foreline region 134 into foreline chamber 106 via foreline inlet 126, and then travel out to the foreline pump 104 via foreline outlet 124.

In various embodiments, foreline chamber can be maintained at a pressure of between about 0.1 Torr and about 10 Torr. Intermediate vacuum chambers 108 and 110 can be maintained at a pressure of between about $1\times10^{4}$ Torr and $2\times10^{-1}$ Torr. In specific embodiments, intermediate vacuum chamber 108 can be maintained at a pressure of between about $1\times10^{-2}$ Torr and about $2\times10^{-1}$ Torr, while intermediate vacuum chamber 110 can be maintained at a pressure of between about $1\times10^{4}$ Torr and about $1\times10^{-2}$ Torr. High vacuum chamber 112 can be maintained at a pressure of about $1\times10^{-12}$ Torr and about $1\times10^{-3}$ Torr.

In various embodiments, the gas flow through inlet 114 can be at least about 50 atm-ml/min, such as at least about 100 atm-ml/min, even at least about 500 atm-ml/min. Generally, the flow through inlet 114 can be not greater than about 10,000 atm-ml/min, even not greater than 5,000 atm-ml/min. Further, the gas flow through inlet 122 can be between about $1\times10^{-2}$ atm-ml/min to about $1\times10^{2}$ atm-ml/min.

Figure 2:
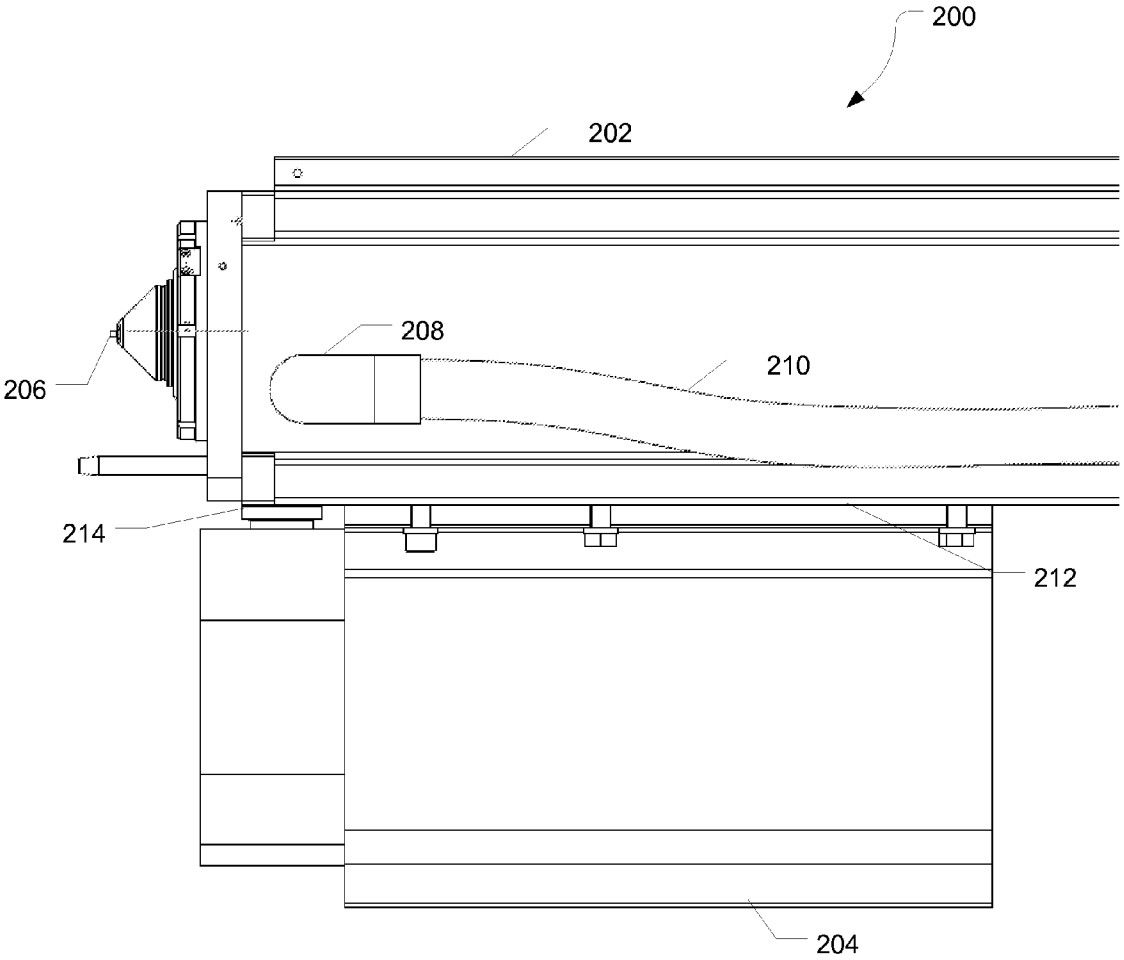
FIG. 2 is an external view of an exemplary vacuum manifold and high vacuum pump for a mass spectrometer, in accordance with various embodiments.

FIG. 2 is side view illustrating an exemplary vacuum system 200 for a mass spectrometer. Vacuum system 200 can include mass spectrometer vacuum manifold 202 and high vacuum pump 204. Mass spectrometer vacuum manifold 202 can include inlet 206 and foreline outlet 208. Foreline outlet 208 can be coupled to a foreline pump (not shown) via vacuum hose 210. High vacuum pump 204 can be coupled to mass spectrometer vacuum manifold via high vacuum pump-vacuum manifold interface 212 and foreline port-foreline inlet coupling 214. High vacuum pump-vacuum manifold interface 212 can include multiple connections between outlets of various intermediate and high vacuum chambers of the mass spectrometer vacuum manifold 202 and stages of the high vacuum pump 204.

Figure 3:
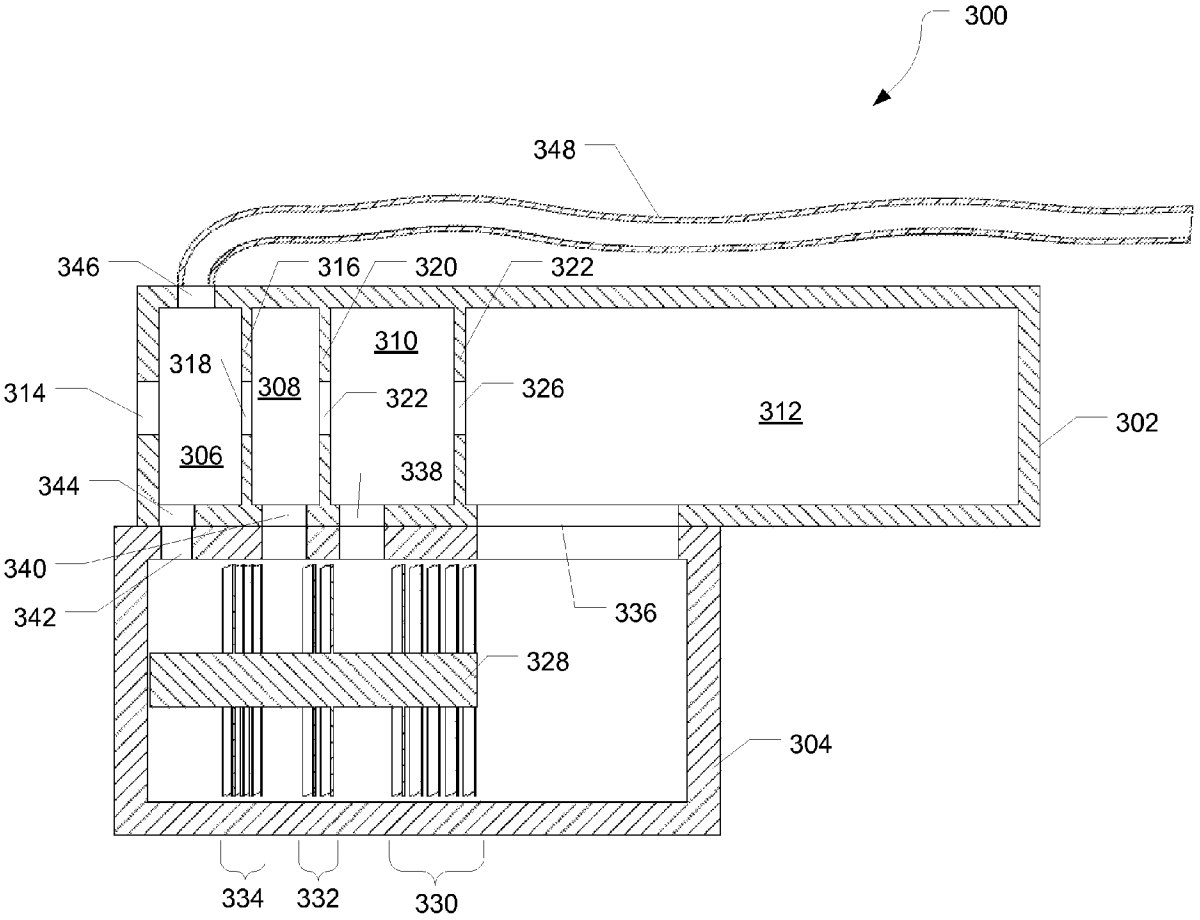
FIG. 3 is a cross section view of an exemplary vacuum manifold and high vacuum pump for a mass spectrometer, in accordance with various embodiments.

FIG. 3 is cross section view illustrating an exemplary vacuum system 300 for a mass spectrometer. Vacuum system 300 can include mass spectrometer vacuum manifold 302 and high vacuum pump housing 304.

Mass spectrometer vacuum manifold 302 can define foreline chamber 306, intermediate vacuum chamber 308, intermediate vacuum chamber 310, and high vacuum chamber 312. In various embodiments, the mass spectrometer vacuum manifold 302 can be a monolithic manifold, such as a manifold machined from a single block of material, or a multi-component manifold, such as a manifold assembled from multiple pieces of material. Inlet 314 can provide an opening into foreline chamber 306 for ions from a source (not shown) to enter vacuum system 300. Foreline chamber 306 and intermediate vacuum chamber 308 can be separated by a baffle 316 having an aperture 318 therein to connect foreline chamber 306 and intermediate vacuum chamber 308. Intermediate vacuum chamber 308 and intermediate vacuum chamber 310 can be separated by a baffle 320 having an aperture 322 therein to connect intermediate vacuum chamber 308 and intermediate vacuum chamber 310. Intermediate vacuum chamber 310 and high vacuum chamber 312 can be separated by a baffle 324 having an aperture 326 therein to connect intermediate vacuum chamber 310 and high vacuum chamber 312.

High vacuum pump housing 304 can contain high vacuum pump 328. High vacuum pump 328 can include a main stage 330, an interstage 332, and an interstage stage 334. High vacuum chamber 312 can be coupled to main stage 330 via outlet 336. Intermediate vacuum chamber 310 can be coupled to interstage 332 via outlet 338. Intermediate vacuum chamber 308 can be coupled to drag stage 334 via outlet 340.

High vacuum pump 328 can further include foreline port 342 coupled to foreline inlet 344 opening into foreline chamber 306. Foreline outlet 346 from foreline chamber 306 can be coupled to a foreline pump (not shown) via vacuum hose 348.

In various embodiments, at least two of outlet 336, outlet 338, and outlet 340 can be substantially coplanar. In some embodiments, one of outlet 336, outlet 338, and outlet 340 can be offset and in a plane substantially parallel to at least another of outlet 336, outlet 338, and outlet 340. Alternatively, one of one of outlet 336, outlet 338, and outlet 340 can be in a plane rotated, such as intersecting or even perpendicular, relative to the plane or planes of the other two of outlet 336, outlet 338, and outlet 340.

In various embodiments, the foreline inlet 344 can be substantially coplanar with one or more of outlet 336, outlet 338 or outlet 340. In other embodiments, the foreline inlet 344 can be offset and in a plane substantially parallel to one or more of outlet 336, outlet 338 or outlet 340. Alternatively, foreline inlet 344 can be in a plane rotated, such as intersecting or even perpendicular, relative to the plane or planes of the other two of outlet 336, outlet 338, and outlet 340.

In various embodiments, aperture 318 can have a cross-sectional area of between about 0.4 $mm^2$ and about 40 $mm^2$, aperture 322 can have a cross-sectional area of between about 0.4 $mm^2$ and about 40 $mm^2$, and aperture 326 can have a cross-sectional area of between about 0.4 $mm^2$ and about 40 $mm^2$. Outlet 344 can have a cross-section of between about 400 $mm^2$ to about 2,500 $mm^2$. Outlet 340 can have a cross-sectional area of between about 400 $mm^2$ and about 12,000 $mm^2$, outlet 338 can have a cross-sectional area of between about 400 $mm^2$ and about 12,000 $mm^2$, and outlet 336 can have a cross-sectional area of between about 5,000 $mm^2$ and about 36,000 $mm^2$.

Mass Spectrometry Platforms

Figure 4:
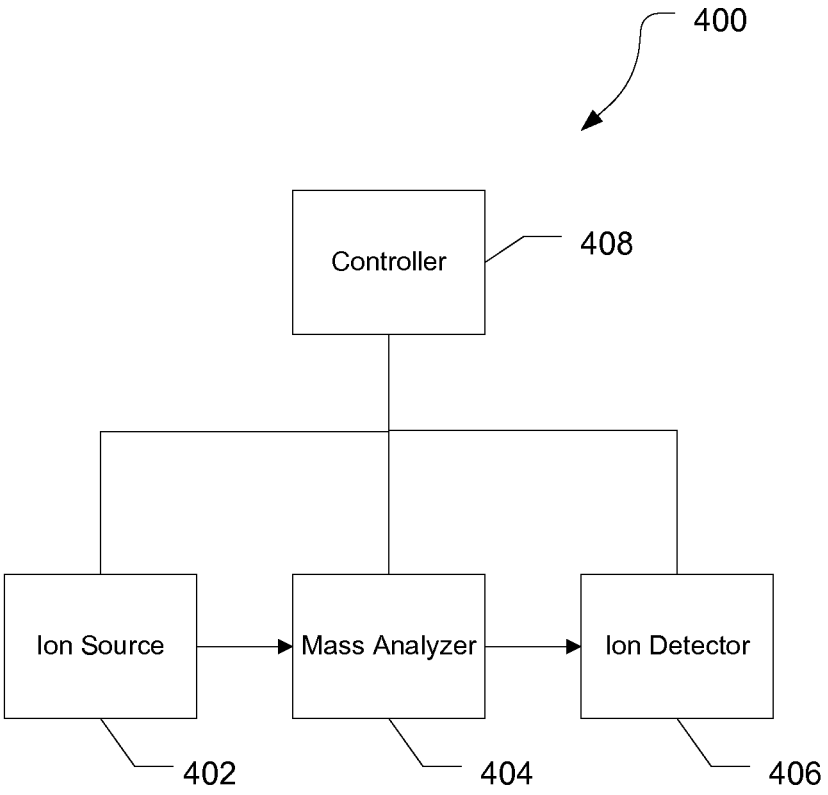
FIG. 4 is a block diagram of an exemplary mass spectrometry system, in accordance with various embodiments.

Various embodiments of mass spectrometry platform 400 can include components as displayed in the block diagram of FIG. 4. In various embodiments, elements of FIG. 1 can be incorporated into mass spectrometry platform 400. According to various embodiments, mass spectrometer 400 can include an ion source 402, a mass analyzer 404, an ion detector 406, and a controller 408.

In various embodiments, the ion source 402 generates a plurality of ions from a sample. The ion source can include, but is not limited to, a matrix assisted laser desorption/ionization (MALDI) source, electrospray ionization (ESI)

source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 404 can separate ions based on a mass to charge ratio of the ions. For example, the mass analyzer 404 can include a quadrupole mass filter analyzer, a time-of-flight (TOF) analyzer, a quadrupole ion trap analyzer, an electrostatic trap (e.g., Orbitrap) mass analyzer, and the like. In various embodiments, the mass analyzer 404 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 406 can detect ions. For example, the ion detector 406 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 408 can communicate with the ion source 402, the mass analyzer 404, and the ion detector 406. For example, the controller 408 can configure the ion source or enable/disable the ion source. Additionally, the controller 408 can configured the mass analyzer 404 to select a particular mass range to detect. Further, the controller 408 can adjust the sensitivity of the ion detector 406, such as by adjusting the gain. Additionally, the controller 408 can adjust the polarity of the ion detector 406 based on the polarity of the ions being detected. For example, the ion detector 406 can be configured to detect positive ions or be configured to detected negative ions.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

What is claimed is:

1. A mass spectrometer system, comprising:
a vacuum manifold including:
a foreline chamber having a source inlet, a foreline inlet, and a foreline outlet; and
a high vacuum chamber; and
a high vacuum pump having
a vacuum port coupled to high vacuum chamber; and
a foreline port coupled to the foreline inlet,
wherein gases from the high vacuum pump flow through the foreline chamber and out to a foreline pump via the foreline outlet.

2. The mass spectrometer system of claim 1, further comprising the foreline pump coupled to the foreline outlet.

3. The mass spectrometer system of claim 1, wherein the foreline chamber is operable at a pressure of between about 0.1 Torr and about 10 Torr.

4. The mass spectrometer system of claim 1, wherein the high vacuum chamber is operable at a pressure of between about $1\times10^{-12}$ Torr and about $1\times10^{-3}$ Torr.

5. The mass spectrometer system of claim 1, further comprising an intermediate vacuum chamber between the foreline chamber and the high vacuum chamber.

6. The mass spectrometer system of claim 5, wherein the intermediate vacuum chamber is operable at a pressure of between about $1\times10^{-4}$ Torr and $2\times10^{-1}$ Torr.

7. The mass spectrometer system of claim 1, further comprising two intermediate vacuum chambers between the foreline chamber and the high vacuum chamber.

8. The mass spectrometer system of claim 1, further comprising a mass analyzer within the high vacuum chamber.

9. The mass spectrometer system of claim 1, wherein the vacuum manifold is a monolithic vacuum manifold.

10. A mass spectrometer system, comprising:
a vacuum manifold including:
a foreline chamber having a foreline inlet and a foreline outlet;
a high vacuum chamber; and
an intermediate vacuum chamber located between the foreline chamber and the high vacuum chamber; and
a high vacuum pump including:
a main stage coupled to the high vacuum chamber;
an intermediate stage coupled to the intermediate vacuum chamber; and
foreline port coupled to the foreline chamber;
wherein gases from the high vacuum pump flow through the foreline chamber and out to a foreline pump via the foreline outlet.

11. The mass spectrometer system of claim 10, wherein the foreline chamber is operable at a pressure of between about 0.1 Torr and about 10 Torr.

12. The mass spectrometer system of claim 10, wherein the high vacuum chamber is operable at a pressure of between about $1\times10^{-12}$ Torr and about $1\times10^{-13}$ Torr.

13. The mass spectrometer system of claim 10, wherein the intermediate vacuum chamber is operable at a pressure of between about $1\times10^{-4}$ Torr and $2\times10^{-1}$ Torr.

14. The mass spectrometer system of claim 10, further comprising a mass analyzer within the high vacuum chamber.

15. The mass spectrometer system of claim 10, further comprising a second intermediate vacuum chamber located between the intermediate vacuum chamber and the high vacuum chamber.

16. The mass spectrometer system of claim 10, wherein the vacuum manifold is a monolithic vacuum manifold.

17. A vacuum manifold for a mass spectrometer system comprising:
a foreline chamber having a source inlet, a foreline inlet, and a foreline outlet;
a first intermediate vacuum chamber separated from the foreline chamber by a first baffle with a first baffle aperture, the first intermediate vacuum chamber having a first vacuum outlet;
a second intermediate vacuum chamber separated from the first intermediate vacuum chamber by a second baffle with a second baffle aperture, the second intermediate vacuum chamber having a second vacuum outlet; and
a high vacuum chamber separated from the second intermediate vacuum chamber by a third baffle with a third baffle aperture, the high vacuum chamber having a third vacuum outlet,
wherein gases from a high vacuum pump flow through the foreline chamber and out to a foreline pump via the foreline outlet.

18. The vacuum manifold of claim 17, wherein the foreline outlet is adapted for connection to the foreline pump.

19. The vacuum manifold of claim 17, wherein the foreline inlet, the first vacuum outlet, the second vacuum outlet, and the third vacuum outlet are adapted for connection to a multiport high vacuum pump.

20. The vacuum manifold of claim 17, wherein the first baffle aperture has a cross-sectional area of between about 0.4 $mm^2$ and about 40 $mm^2$.

21. The vacuum manifold of claim 17, wherein the second baffle aperture has a cross-sectional area of between about 0.4 $mm^2$ and about 40 $mm^2$.

22. The vacuum manifold of claim 17, wherein the third baffle aperture has a cross-sectional area of between about 0.4 $mm^2$ and about 40 $mm^2$.

23. The vacuum manifold of claim 17, wherein the first vacuum outlet has a cross-sectional area of between about 400 $mm^2$ and about 12,000 $mm^2$.

24. The vacuum manifold of claim 17, wherein the second vacuum outlet has a cross-sectional area of between about 400 $mm^2$ and about 12,000 $mm^2$.

25. The vacuum manifold of claim 17, wherein the third vacuum outlet has a cross-sectional area of between about 5,000 $mm^2$ and about 36,000 $mm^2$.

26. The vacuum manifold of claim 17, wherein the vacuum manifold is a monolithic vacuum manifold.

* * * * *